United States Patent [19]

Takase et al.

[11] Patent Number: 4,542,906

[45] Date of Patent: Sep. 24, 1985

[54] COMPUTER AIDED GOLF TRAINING DEVICE

[75] Inventors: Akio Takase, Ota; Kohji Ogawa, Ojima; Takao Tsutsumi, Nitta; Yoshinori Yasuda; Hiroaki Taguchi, both of Ota, all of Japan

[73] Assignee: Mitsubishi Denki Kabushiki Kaisha, Tokyo, Japan

[21] Appl. No.: 527,473

[22] Filed: Aug. 29, 1983

[30] Foreign Application Priority Data

| | | | |
|---|---|---|---|
| Sep. 2, 1982 | [JP] | Japan | 57-153277 |
| Sep. 7, 1982 | [JP] | Japan | 57-155473 |
| Sep. 8, 1982 | [JP] | Japan | 57-156326 |
| Feb. 2, 1983 | [JP] | Japan | 58-15797 |

[51] Int. Cl.[4] ..... A63B 57/00; A63B 69/36

[52] U.S. Cl. ..... 273/185 R; 273/186 C; 273/183 A; 273/181 H; 434/252

[58] Field of Search ..... 273/32 H, 181 H, 181 E, 273/181 A, 181 G, 186 R, 186 B, 186 C, 186 RA, 183 A, 185 A, 185 B, 185 R; 434/247, 252

[56] References Cited

U.S. PATENT DOCUMENTS

| | | | |
|---|---|---|---|
| 2,581,738 | 1/1952 | Williams | 273/181 H |
| 4,150,825 | 4/1979 | Wilson | 273/181 H |
| 4,306,722 | 12/1981 | Rusnak | 273/186 R |
| 4,461,477 | 7/1984 | Stewart | 273/26 R |

*Primary Examiner*—Richard C. Pinkham
*Assistant Examiner*—MaryAnn Stoll Lastova
*Attorney, Agent, or Firm*—Oblon, Fisher, Spivak, McClelland & Maier

[57] ABSTRACT

A golf training device for detecting movement of a golf ball and club head including a supporting body which extends toward the golf ball traveling direction. On one side of the supporting body first and second optical signals are output, on the other side the signals are detected. First and second light signals are discriminated by analysis of their detected different phases, and this data is used to analyze ball movement. Club head movement, in one embodiment, is analyzed using fiber optic detectors in the mat.

7 Claims, 17 Drawing Figures

COMPUTER AIDED GOLF TRAINING DEVICE

The present invention relates to an electronic golf training device. More particularly, it relates to a golf training device which detects movement of a ball immediately after it has been impacted by club head, performs processing of an angle in the horizontal direction with respect to a target point to display the result.

There has been mainly used as a simple golf training device, for instance, a golf-swing reforming device, a device for detecting movement of a club head (as described in U.S Pat. No. 4,146,230), a device using a simulated ball and so on. From the viewpoint that golf is a kind of sport that computes the number of hits for putting a golf ball into a cup, it is necessary for a player to be skilled in control of the ball traveling direction and traveling distance. It is, therefore, desirous to have an apparatus which detects and displays data on a ball driven by a golf club correctly and objectively. The golf training devices above-mentioned have, however, been hindered to correctly detect a golf ball driven at a high speed in a random direction with the result of difficulty in satisfying the above-mentioned purpose.

In order to obtain correct data, it is necessary to detect an angle having the horizontal component of the driven ball from the vertical direction and the angle having the vertical component from the horizontal direction. This requires a number of detecting devices such as light emitting elements and photosensitive elements arranged in the vertical and horizontal directions thereby resulting in a large sized device.

It is an object of the present invention to overcome the disadvantage of the conventional device and to provide a golf training device which has a simple structure with a small number of signal producing means and signal detecting means for detecting correctly movement of a golf ball immediately after it has been impacted, from various directions and display correctly a variety of data on the ball to a player.

It is another object of the present invention to provide a golf training device which makes it possible to inform a player of a variety of data on the ball even when the ball is impacted by a golf club having a large loft angle.

It is still another object of the present invention to provide a golf training device which if a player makes a miss-shot, informs the player of the fact, but does not display data on a ball miss-shot.

The foregoing and the other objects of the present invention have been attained by providing a golf training device comprising a supporting body which extends toward a golf ball traveling direction and which has a signal producing means holding part on one side and a signal detecting means holding part on the other side with respect to the reference axis of the golf ball traveling direction; first and second signal producing means consisting of light emitting elements placed along the golf ball traveling direction at a predetermined distance on the signal producing means holding part of the supporting body to emit signals to at least an area where the golf ball is passed; a first signal detecting means consisting of photosensitive elements for detecting the signal from at least the first signal producing means to output a detection signal and a second signal detecting means consisting of photosensitive elements for detecting the signals from the first and second signal producing means to output a detection signal, both the signal detecting means being arranged along the golf ball traveling direction at a predetermined distance on the signal detecting means holding part of the supporting body; an operation-processing means which receives output signals from the first and second signal detecting means and processes data on the golf ball based on the received signals; and a display means for displaying the result of the processing of the data in the operation-processing means, wherein movement of the ball passing through beams as signals emitted from the first and second signal producing means is caught by detecting the signal by means of the first and second signal detecting means; the outputs of the first and second signal detecting means are fed to the operation-processing means to process them to obtain data on the ball traveling such as each angle in the vertical and horizontal directions, the absolute velocity etc. and the resulted data of the processing operation are shown on a display means.

The foregoing objects, other objects as well as specific construction and improved golf training device will become apparent and understandable from the following detailed description thereof, when read in conjunction with the accompanying drawing.

In the drawing:

FIGS. 7 and 8 are for illustrating a second embodiment of the present invention wherein FIG. 7 is a diagram showing the principle for calculating a ball traveling angle in the horizontal direction and FIG. 8 is block diagram of a circuit according to the second embodiment of the present invention;

Figure 11:
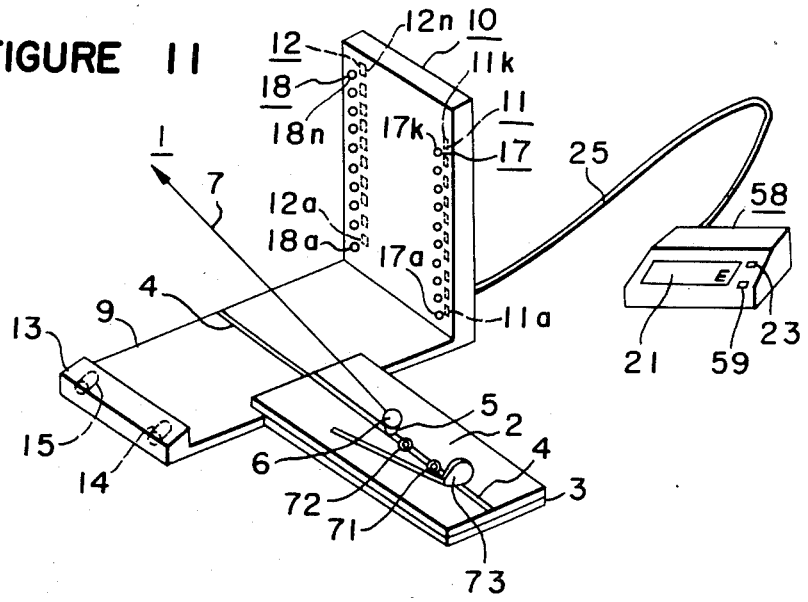
Figure 10:
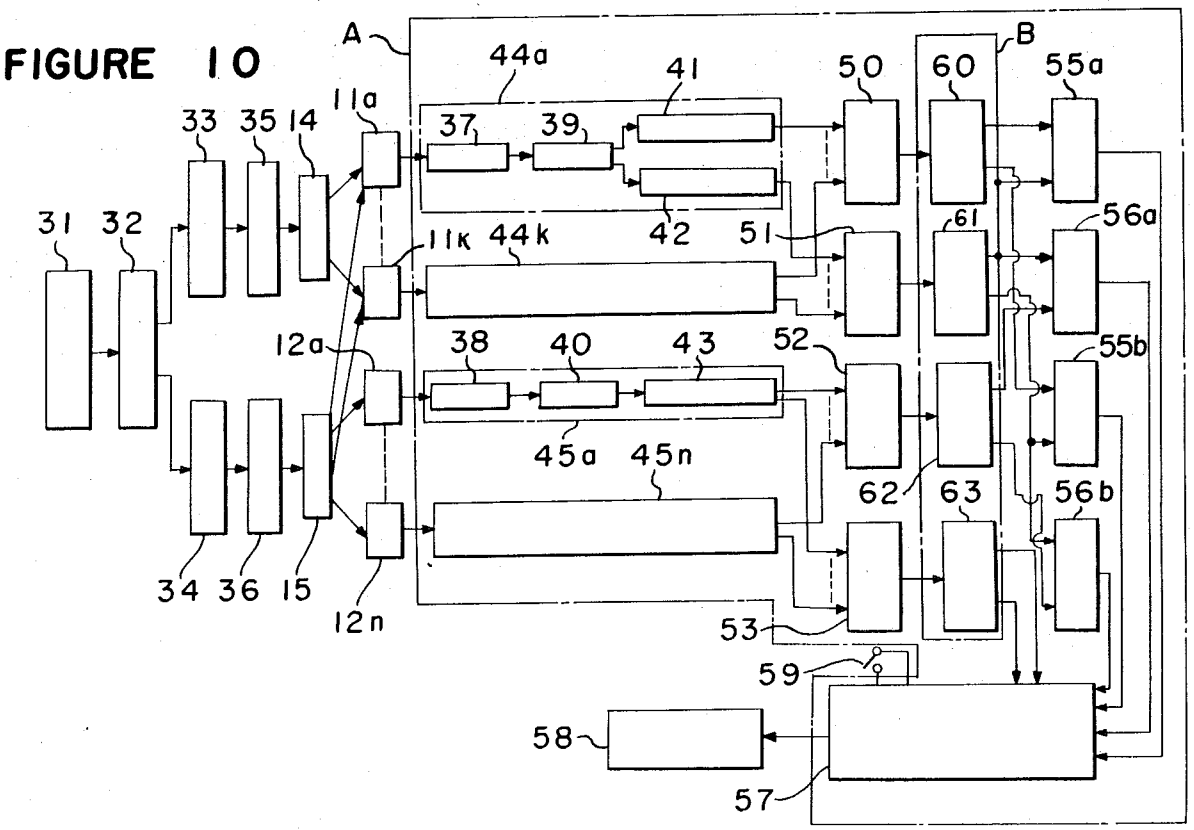
Figure 12:
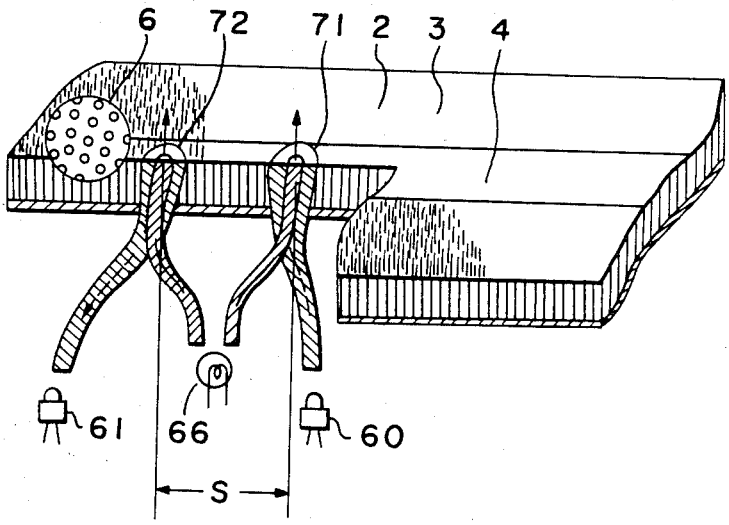
Figure 13:
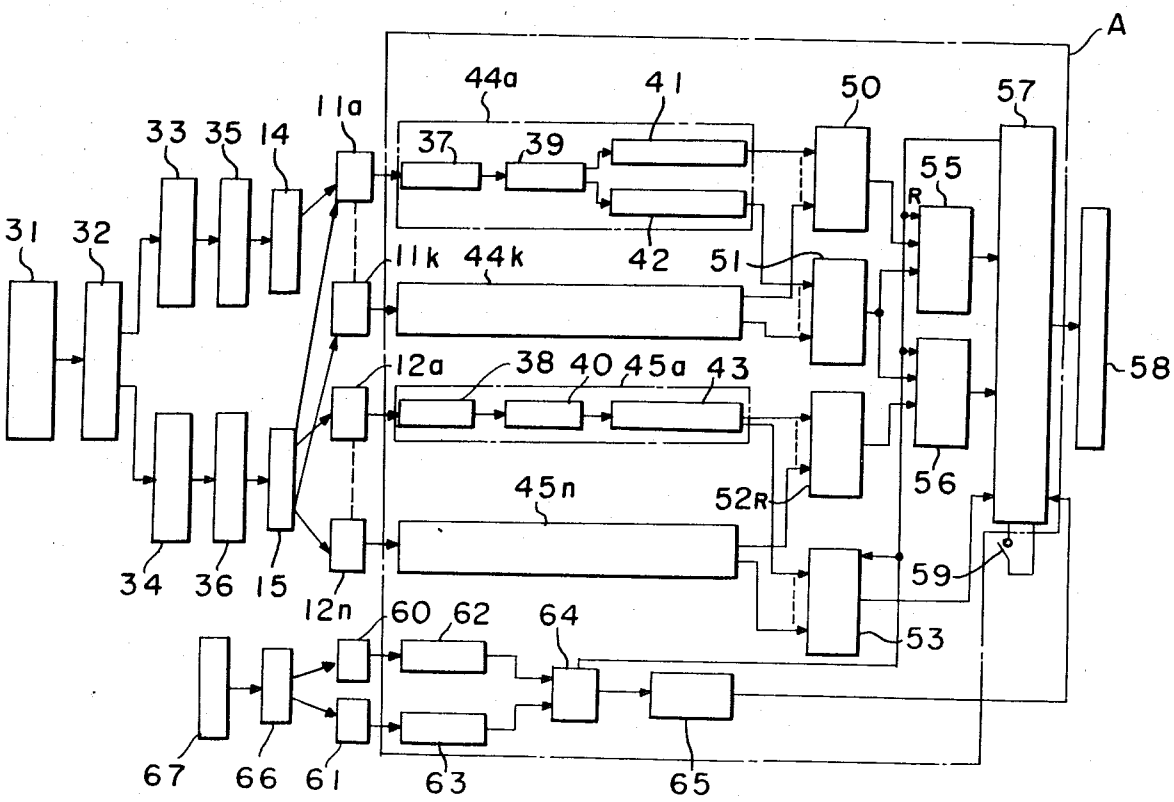
Figure 14:
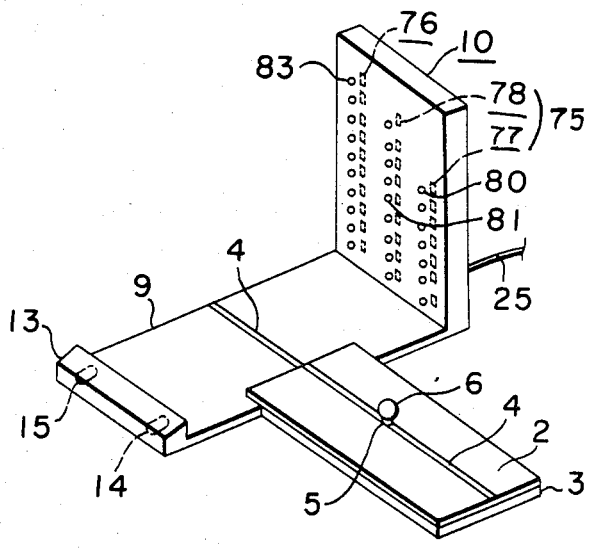

FIGS. 9 an 10 are for illustrating a third embodiment of the present invention wherein FIGS. 9*a* to 9*d* are diagrams for showing sequentially a ball and a club head which are to be detected by a photosensitive element and FIG. 10 is the block diagram of a circuit according to the third embodiment of the invention;

FIGS. 11 to 13 are for illustrating a fourth embodiment of the present invention wherein FIG. 11 is a slant view of the golf training device;

FIG. 12 is a schematic view partly sectioned to show a club head speed detecting part;

FIG. 13 is a circuit diagram according to the fourth embodiment of the present invention; and FIG. 14 is a slant view of modified arrangement of photosensitive elements of the golf training device of the present invention.

A first embodiment of the present invention will be described with reference to FIGS. 1 to 6.

Figure 1:
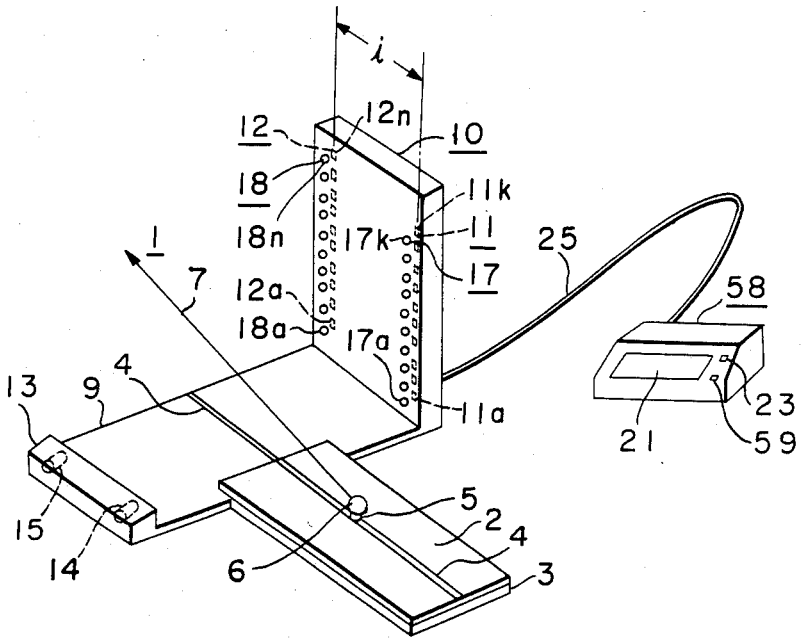
FIG. 1 is a slant view of a first embodiment of the golf training device of the present invention.
Figure 2:
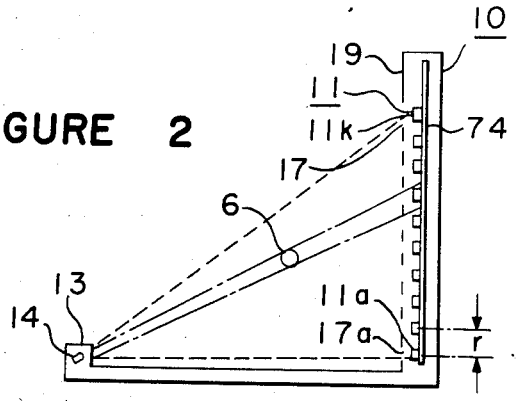
FIG. 2 is a cross sectional view of a body part of the golf training device in which a positional relationship of light emitting elements and photosensitive elements is shown.

In FIG. 1, the reference numeral 1 designates the body of a golf training device, the numeral 2 designates a lawn-like mat mounted on a first base plate 3, the numeral 4 designates a white line as a target direction which is drawn on the mat and a second base plate 9 described below, the numeral 5 designates a tee set up on the first base plate 3 through the mat 2, the numeral 6 designates a golf ball put on the tee, the numeral 7 designates an ideal ball traveling line whose projection from the top is in alignment with the white line 4. The second base plate 9 is formed in one-piece with the first base plate 3 to thereby constitute a supporting body which products toward the ball traveling direction. The numeral 10 designates a signal detecting means holding part, or a so-called photosensitive element fixture part having a hollow portion which is set up at one end of the second base plate 9 opposing a player with respect to the ideal ball traveling line 7, and which contains photosensitive element groups 11, 12, a fitting plate 74 and an electric circuit described later, the numerals 12, 11 respectively designate first and second signal detecting means which are respectively composed of a group of photosensitive elements which are arranged on the fitting plate 74 of the photosensitive element fixture part 10 in parallel each other in the vertical direction, the first and second signal detecting means being placed substantially perpendicular to the upper surface of the mat 2 with a predetermined distance i in the lateral direction with respect to the ideal ball traveling line 7. The group of the photosensitive elements 11 comprises a plurality of photosensitive elements 11*a* . . . 11*k* arranged at an interval $\gamma$ and similarly, the group of the photosensitive elements 12 comrpises photosensitive elements 12*a* . . . 12*n*. The distance $\gamma$ is determined so as to be smaller than the diameter of a golf ball 6 by a predetermined dimension. A smaller distance $\gamma$ increases accuracy of the measurement of the ball.

The reference numeral 13 designates a signal producing means holding part, or a so-called light emitting element fixture part having a hollow portion which is provided at the end of the second base plate 9 opposing the photosensitive element fixture part 10 with respect to the ideal ball traveling line 7 and which is provided with a pair of through holes (not shown) for letting beams emitted from light emitting elements 14, 15 pass therethrough, the numerals 14, 15 respectively designate the first and second signal emitting means such as light emitting elements which are placed in the signal producing element fixture part 13 and each opposes each group of the photosensitive elements 11, 12 in the direction crossing the white line 4 at the right angle.

The light emitting element 14 has an optical axis adapted to be in coincidence with the central portion between the photosensitive element groups 11, 12 so as to irradiate the whole area of both the groups 11, 12. Similarly, the light emitting element 15 has an optical axis adapted to be in concidence with the central portion of the photosensitive element group 12 so as to irradiate the whole area of the group. The numerals 17, 18 respectively designate groups of through holes formed in a cover plate 19 for protecting the front area of the photosensitive element groups 11, 12. The group of the through holes 17 consists of through holes 17*a* . . . 17*k* each corresponding to each the photosensitive element 11*a* . . . 11*k* and the group of the through holes 18 consists of through holes 18*a* . . . 18*n* each corresponding to each the photosensitive element 12*a* . . . 12*n*.

The reference numeral 58 designates a display device, described below in detail, which performs processing of signals from the golf training device body 1 to display data concerning a golf swing, the numeral 21 designates a display part, the numeral 23 designates a main switch, the numeral 59 designates a selecting switch for a club which will be described below and the numeral 25 designates a cable.

The principle of the first embodiment of the present invention will be described with reference to FIGS. 3 to 5 which show as modeled representations relations of the photosensitive element groups 11, 12, the light emitting elements 14, 15 and the ball traveling line.

Figure 3:
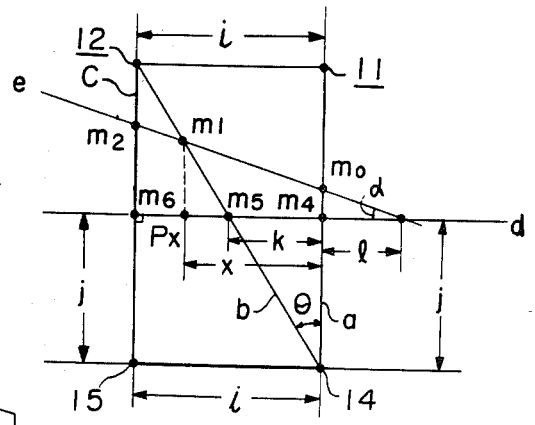
FIG. 3 is a diagram showing the principle for calculating a ball traveling angle in the horizontal direction.

FIG. 3 is a diagram showing the principle for calculating an angle of ball traveling in the horizontal direction. A linear line a is the projection from the top of a plane a of light emitted from the light emitting element 14 to the photosensitive element group 11. A linear line b is the projection from the top of a plane b of light emitted from the light emitting element 14 to the photosensitive element group 12. The linear line c is the projection from the top of a plane c of light emitted from the light emitting element 15 to the photosensitive element group 12, the linear line c being parallel to the linear line a. The linear line d is the projection from the top of an ideal ball traveling line 7 of the ball and intersects the linear lines a and c at the right angle. The symbol i designates the distance between the photosensitive element groups 11, 12 the symbol j designates the distance from the photosensitive elements 14, 15 to the linear line d, the symbol l designates the distance from a position s where the ball 6 is put to the linear line a and the symbol $\theta$ designates an intersecting angle formed by the linear lines b and a.

When the ball 6 is hit to travel along the ball traveling line e, the traveling line e corresponds to the linear line e in view of the projection from the top and the intersecting angle $\alpha$ formed by the linear lines e and d represents an angle of the traveling line e of the ball 6, deflected in the horizontal direction. The symbols $m_0$, $m_1$ and $m_2$ respectively designate points given by the projection from the top of the points $M_0$, $M_1$ and $M_2$ which are respectively formed by the intersection of the ball traveling line with the light planes a, b and c, hence the points $m_0$, $m_1$ and $m_2$ respectively on the linear lines a, b and c. The symbols $m_4$, $m_5$ and $m_6$ respectively designate points given by the intersection of the linear line d with the linear lines a, b and c, and the symbol Px designates a point of the perpendicular from the point $m_1$ to the linear line d. When the distance between the points $m_4$ and Px is represented by x, the time $T_1$ required for passing of the ball 6 through the distance between the points $M_0$ and $M_1$ and the time $T_2$ required for passing of the ball 6 through the distance between the points $M_1$ and $M_2$ are measured, the following equation is given by a simple geometrical calculation:

$$x = \frac{T_1}{T_1 + T_2} \tag{1}$$

The distance between the points $m_4$ and $m_5$ is represented by the following equation:

$$K = j \tan \theta \tag{2}$$

Furthermore, the following equation is given according to a geometrical calculation from the diagram shown in FIG. 3:

$$\alpha = \tan^{-1}\left(\frac{iT_1 - j(T_1 + T_2)\tan\theta}{[iT_1 + l(T_1 + T_2)]\tan\theta}\right) \quad (3)$$

Judgement as to whether the angle $\alpha$ deflects in the right direction or in the left direction is obtainable by comparing the equation (1) with the equation (2). Namely, the ball traveling line deflects in the right direction when $K > x$, whereas it deflects in the left direction when $K < x$.

Figure 4:
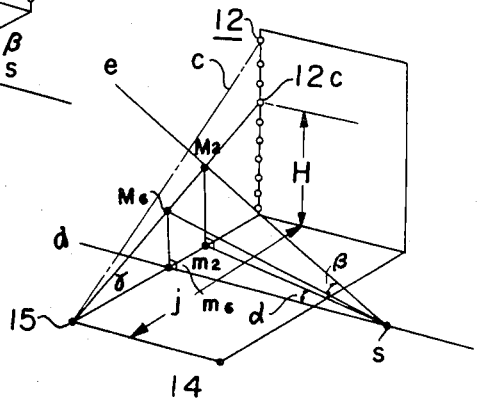
FIG. 4 is a diagram showing the principle for calculating a ball traveling angle in the vertical direction.
Figure 6:
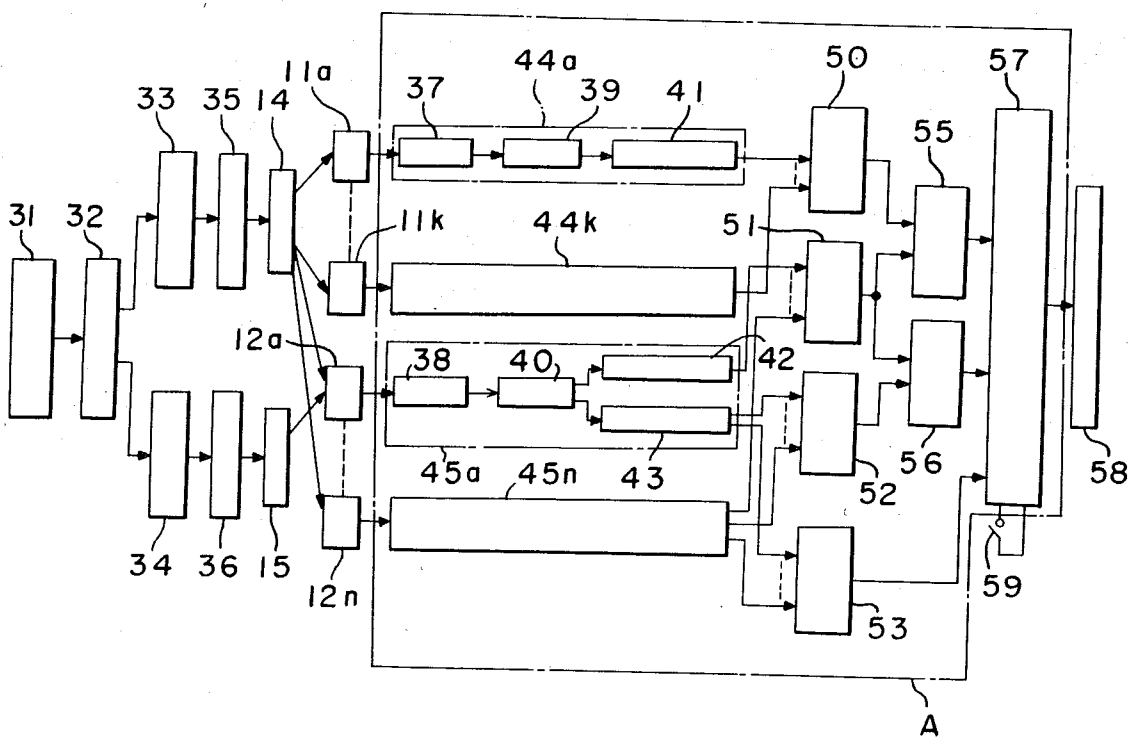
FIG. 6 is the block diagram of a circuit of the first embodiment of the golf training device of the present invention.

FIG. 4 is a diagram showing the principle for calculating an angle of the ball traveling line in the vertical direction.

From FIG. 4, the following equation is given:

$$\tan\gamma = \frac{H}{J} \quad (4)$$

wherein H is height of the photosensitive element 12*c* which detects a point $M_2$ given by the intersection of the ball 6 with the light plane c, $\beta$ is angle of elevation formed by the ball traveling line e and the horizontal plane, $\gamma$ is angle of incidence of light emitted from the light emitting element 15 to the photosensitive element 12*c* and J is distance from the light emitting 15 to the photosensitive element group 12.

Further, the following equation is given according to a simple geometrical calculation:

$$\beta = \tan^{-1}\left(\frac{\cos\alpha \cdot \tan\gamma}{l + i}[(l + i)\tan\alpha + j)]\right) \quad (5)$$

Figure 5:
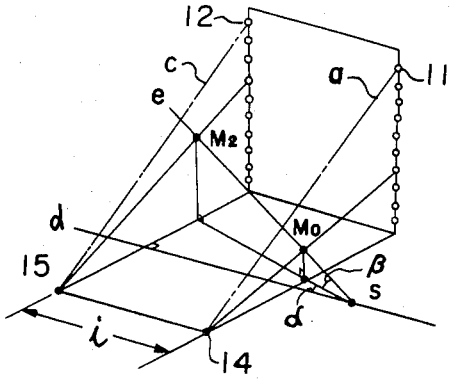
FIG. 5 is a diagram showing the principle for calculating speed of a ball in the traveling direction.

FIG. 5 is a diagram for calculating an absolute velocity of the ball 6 immediately after its having been impacted. When time difference for the distance from the point $M_0$ traversing the light plane a to the point $M_2$ traversing the light plane c and the distance between the points $M_0$ and $M_2$ are obtained, the following equation is calculated:

$$V = \frac{1}{T_1 + T_2} \cdot \frac{i}{\cos\alpha \cdot \cos\beta} \quad (6)$$

Accordingly, as is explained with reference to FIGS. 3 to 5, when a geometrical relationship of a position where the ball 6 is set and positions of the light emitting elements 14 and 15, the photosensitive element groups 11 and 12 and their respective photosensitive elements 11*a* . . . 11*k* and photosensitive elements 12*a* . . . 12*n* is fixed, the traveling direction and the speed of the ball 6 can be processed and displayed according to the equations (1) to (6) by detecting the time differences $T_1$, $T_2$ and the height H.

The principle mentioned above will be explained with reference to FIG. 6 which shows a circuit realized as a practical system.

In the figure, the reference numeral 31 designates an oscillation circuit for oscillating a high frequency signal; the numeral 32 designates a modulation circuit for separating the high frequency signal into a signal A and a signal B different in their phases to output them; the numeral 33 designates a signal-A amplification circuit; the numeral 34 designates a signal-B amplification circuit; the numerals 35, 36 respectively designate driving circuits each driving the light emitting elements 14 or 15, the phases of the beams emitted from the light emitting elements are different each other and are easily separable; the numerals 37, 38 respectively designate amplification circuits each amplifying detected signals from the photosensitive elements 11*a* . . . 11*k* or the photosensitive elements 12*a* . . . 12*n;* the numerals 39, 40 respectively designate demodulation circuits for removing noise component and shaping the waveform of signals; the numerals 41 designates a signal-A detection circuit for receiving the signal from the demodulation circuit 39 to detect the signal A; the numeral 42 designates a signal-A detection circuit for receiving the signal from the demodulation circuit 40 to detect the signal A; the numeral 43 designates a signal-B detection circuit, similar to the above-mentioned signal-A detection circuit 42, for receiving the signal from the demodulation circuit 40 to detect the signal B; the numerals 44*a* . . . 44*k* respectively designate detection circuits each consisting of the amplification circuit 37, the demodulation circuit 39, the signal-A detection circuit 41; the numerals 45*a* . . . 45*n* respectively designate detection circuits each consisting of the amplification circuit 38, the demodulation circuit 40, the signal-A detection circuit 42 and the signal-B detection circuit 43. The reference numeral 50 designates a signal-A interruption detecting circuit which receives a detection signal for the signla A from the signal-A detection circuit 41 and detects that the ball 6 has interrupted the light from the light emitting element 14 to the photosensitive elements 11*a* . . . 11*k;* the numeral 51 designates a signal-A interruption detecting circuit which receives a detection signal for the signal A from the signal-A detection circuit 42 and detects that the ball 6 has interrupted the light from the light emitting element 15 to the photosensitive elements 12*a* . . . 12*n;* the numeral 52 designates a signal-B interruption detecting circuit which receives a detection signal from the signal-B detection circuit 43 and detects that the ball 6 has interrupted the light from the light emitting element 15 to the photosensitive elements 12*a* . . . 12*n;* the numeral 53 designates a position detecting circuit which receives a detection signal for the firstly occurring signal B from the signal-B detection circuit 43 and detects a light beam interrupted by the ball 6 among the light beams from the light emitting 15 to the photosensitive elements 12*a* . . . 12*n* to output a signal indicative of the position of the photosensitive element interrupted by the ball; the numeral 55 designates a timer which starts time measurements with a firstly occurring interruption signal from the signal-A interruption detecting circuit 50 and stops its time measurement with firstly occurring interruption signal from the signal-A interruption detecting circuit 51; the numeral 56 designates a timer which starts time measurement with a firstly occurring interruption signal from the signal-A interruption detecting circuit 51 and stops its time measurement with a firstly occuring interruption signal from the signal-B interruption detecting circuit 52; the numeral 57 designates a logical operation circuit which receives outputs from the position detecting circuit 53, and the timers 55, 56 to output data on the ball impacted such as a ball traveling angle in the horizontal direction, speed in the ball traveling direction and so on and the logical operation circuit 53 constitutes an operation-processing means A together with the detection circuits 44*a* . . . 44*k* and 45*a* . . . 45*n*, the signal interruption detecting circuits 50, 51, 52, the position detecting circuit 53 and the timers 55, 56; and the numeral 58 designates a display device for displaying information on the ball impacted according to the data from the logical operation circuit. The reference numeral 59 designates a selective switch for club which makes it possible to calibrate processing operations in the logical operation circuit 57 for an iron club for hitting the ball 6 on the mat 2 or an wood club for hitting the ball on the mat 2 through the tee 5.

The operation of the golf training device having a structure described above will be explained.

First of all, the selective switch 59 is switched to the position for wood club and the ball 6 on the tee 5 is hit. The ball 6 hit traverses the light planes a, b and c formed by the light emitting elements 14, 15 and the photosensitive element groups 11, 12. Each of the photosensitive element groups 11, 12 usually receives light from the respective light emitting elements 14, 15 to output respectively the signal A from the detection circuits 44*a* . . . 44*k* and to output respectively the signal A and the signal B from the detection circuits 45*a* . . . 45*n*. Interruption of the light producing by traversing of the light plane a by the ball 6 is detected by the signal-A interruption detecting circuit 50 and the output resulted by such detection starts the timer 55. Subsequently interruption of the light produced by traversing of the light plane b by the ball 6 is detected by the signal-A interruption detecting circuit 51. The output resulted by such detection causes to stop the time measurement of the timer 55 and at the same time, renders the timer 56 to start. Further, interruption of the light produced by traversing of the light plane c by the ball 6 is detected by the signal-B interruption detection circuit 52 and the position detecting circuit 53 and the output from the signal-B interruption detection circuit 52 stops the time measurement of the timer 56, while the position detecting circuit 53 outputs a signal indicative of a photosensitive element subjected to interruption of light among the photosensitive element group 12. The position detecting circuit 53 and the timers 55, 56 are all so designed that they are driven and stopped with the first occurring signal and are automatically reset after completion of the operations in the logical operation circuit 57. With such construction described above and by the outputs from the timers 55, 56 and the position detecting circuit 53, the logical operation circuit 57 performs processing operation according to the equations (1) to (6) to display on the display device 58 information such as the absolute velocity, the traveling angle in the horizontal direction or in the vertical direction of the ball 6 and so on.

Thus, the golf training device according to the first embodiment of the present invention correctly catches movement of a golf ball immediately after impacted, from various directions and is able to let a player know correct data on the ball in spite of its having a simple construction in which the number of light emitting elements and photosensitive elements is small.

The golf training device of the first embodiment of the present invention is so constructed that a flat-shaped signal producing part is put on the side of a player on the ground and a signal detecting part having a height greater than the signal producing part (such as, for instance, about 60 cm) is provided at the position remote from the signal producing part so that they as a whole occupy a space lower than the player's waist. Accordingly, there is no hindrance for golf swing and a player has no strange feeling to hit a ball. Further, the golf training device is advantageous in that it requires a relatively small number of light emitting elements and photosensitive elements, the equipment can be made compact to thereby allow easy transportation and it makes possible to hit a practical ball even in a small space. Also, the light emitting elements are so assembled that their optical axes are previously set whereby operations such as adjustment of the optical axes when used are eliminated and a highly reliable operation is obtained.

In the first embodiment, the light emitting element 14 has its optical axis adapted to be in coincidence with the central portion of the photosensitive element groups 11, 12 so as to irradiate the whole area of the groups 11, 12 and the light emitting element 15 has its optical axis adapted to be in coincidence with the central portion of the photosensitive element group 12 so as to irradiate the whole area of the group 12. The same effect can be obtained even by replacing, positions of the light emitting element 14 and 15.

A second embodiment of the golf training device according to the present invention will be described with reference to FIGS. 7 and 8.

In the embodiment, the optical axis of the light emitting element 14 is set to direct the central portion of the photosensitive element group 11 so that the light emitting element 14 irradiates the whole area of the group 11, while the optical axis of the light emitting element 15 is set to direct to the central portion of the photosensitive element groups 11, 12 so that the light emitting element irradiates the whole area of the groups 11, 12.

The construction of the golf training device body of the second embodiment is the same as that of the first embodiment, provided that the photosensitive element group 11 is referred to as the second signal detecting means; the photosensitive element group 12 as the first signal detecting means; the light emitting element 14 as the second signal producing means; and the light emitting element 15 as the first signal producing means.

The principle of the second embodiment will be described with reference to FIG. 7 which shows as a modeled representation relationship of the photosensitive element groups 11, 12, the light emitting elements 14, 15 and the ball traveling line.

Figure 7:
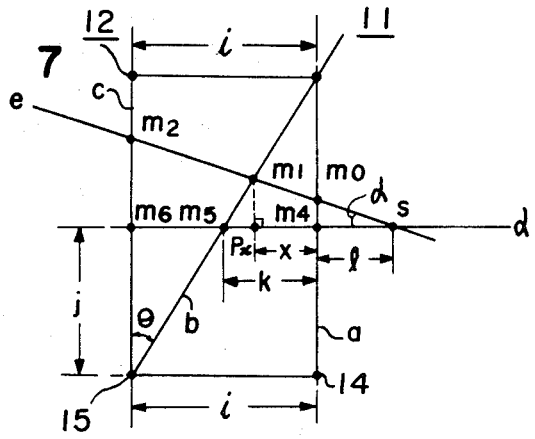
Figure 8:
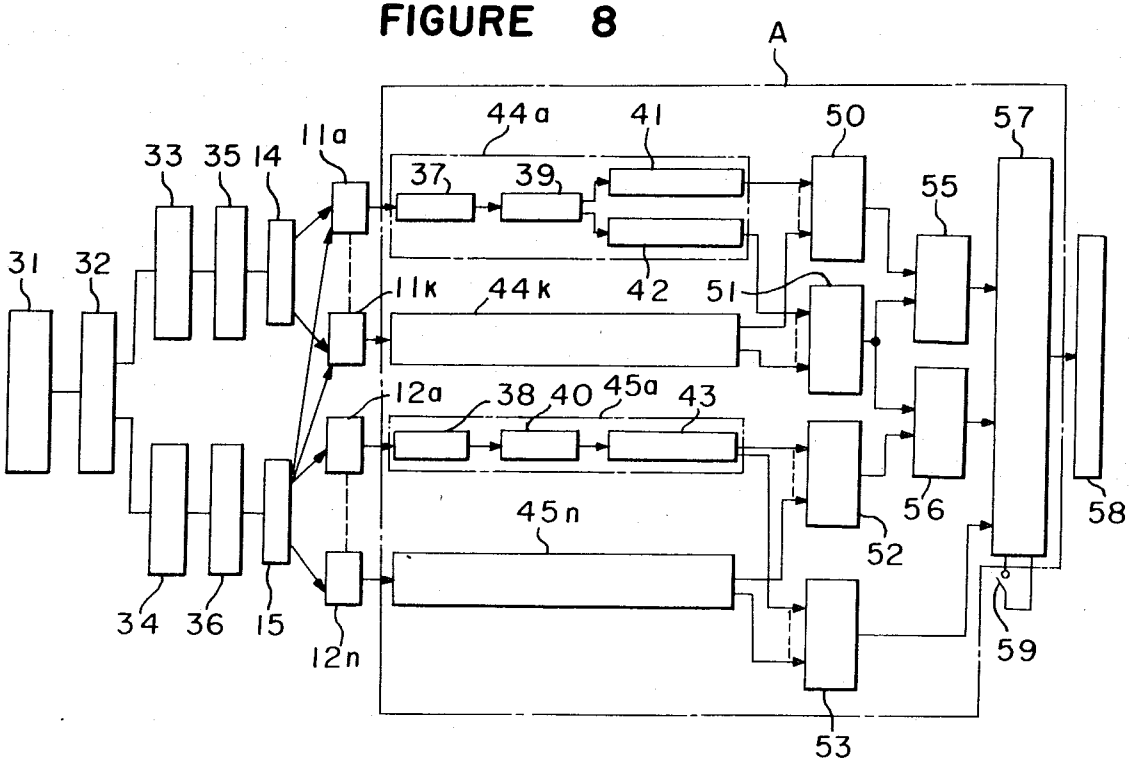
Figure 9A:
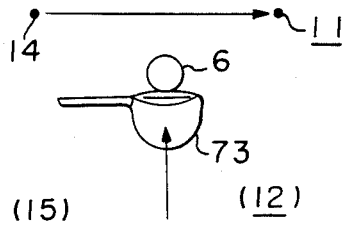
Figure 9B:
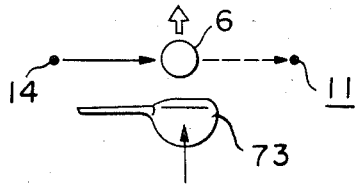
Figure 9C:
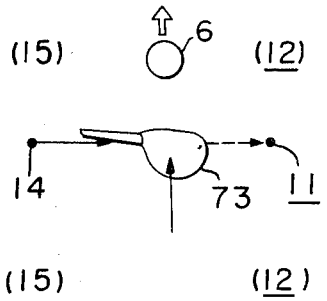
Figure 9D:
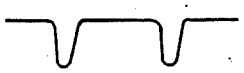

FIG. 7 is a diagram showing the principle for calculating an angle of ball traveling in the horizontal direction. A linear line a is the projection from the top of a plane a of light emitted from the light emitting element 14 to the photosensitive element group 11. A linear line b is the projection from the top of a plane b of light emitted from the light emitting element 15 to the photosensitive element group 11. The linear line c is the projection from the top of a plane c of light emitted from the light emitting element 15 to the photosensitive element group 12, the linear line c being parallel to the linear line a. The linear line d is the projection from the top of an ideal ball traveling line 7 of the ball 6 with respect to the horizontal component of the ball traveling direction and the linear line d intersects the linear lines a and c at the right angle. The symbol i designates the distance between the photosensitive element groups 11, 12, the symbol j designates the distance from the photosensitive element 15 to the linear line d, the symbol l designates the distance from a position s where the ball 6 is put to the linear line a and the symbol $\theta$ designates an intersecting angle formed by the linear lines b and c.

When the ball 6 is hit to travel along the ball traveling line e, the traveling line e corresponds to the linear line e in view of the projection from the top and the intersecting angle $\alpha$ formed by the linear lines e and d represents an angle of the traveling line e of the ball 6, deflected in the horizontal direction. The symbols $m_0$, $m_1$ and $m_2$ respectively designate points given by the projection from the top of the points $M_0$, $M_1$ and $M_2$ which are respectively formed by the intersection of the ball traveling line with the light planes a, b and c, hence the points $m_0$, $m_1$ and $m_2$ respectively on the linear lines a, b and c. The symbols $m_4$, $m_5$ and $m_6$ respectively designate points given by the intersection of the linear line d with the linear lines a, b and c, and the symbol Px designates a point of the perpendicular from the point $m_1$ to the linear line d. When the distance between the points $m_4$ and Px is represented by x, the time $T_1$ required for passing of the ball 6 through the distance between the points $M_0$ and $M_1$ and the time $T_2$ required for passing of the ball 6 through the distance between the points $M_1$ and $M_2$ are measured, the following equation is given by a simple geometrical calculation:

$$x = \frac{T_1}{T_1 + T_2} i \tag{7}$$

The distance between the points $m_4$ and $m_5$ is represented by the following equation:

$$K = i - j \tan \theta \tag{8}$$

Furthermore, the following equation is given according to a geometrical calculation from the diagram shown in FIG. 7:

$$\alpha = \tan^{-1}\left(\frac{iT_2 - j(T_1 + T_2)\tan\theta}{[iT_1 + l(T_1 + T_2)]\tan\theta}\right) \tag{9}$$

Judgement as to whether the angle $\alpha$ deflects in the right direction or in the left direction is obtainable by comparing the equation (7) with the equation (8). Namely, the ball traveling line deflects in the right direction when $K > x$, whereas it deflects in the left direction when $K < x$.

The principle for calculting an angle of the ball traveling line in the vertical direction or the absolute velocity of the ball is the same as that shown in FIG. 4 or FIG 5 respectively. Accordingly, the following equations are given:

$$\tan \gamma = \frac{H}{J} \tag{10}$$

$$\beta = \tan^{-1}\left(\frac{\cos\alpha \cdot \tan\gamma}{l + i}[(l + i)\tan\alpha + j]\right) \tag{11}$$

$$V = \frac{1}{T_1 + T_2} \cdot \frac{i}{\cos\alpha \cdot \cos\beta} \tag{12}$$

Accordingly, when a geometrical relationship of a position where the ball 6 is set and positions of the light emitting elements 14 and 15, the photosensitive element groups 11 and 12 and their respective photosensitive elements 11*a* . . . 11*k* and photosensitive elements 12*a* . . . 12*n* is fixed, the traveling direction and the speed of the ball 6 can be processed and displayed according to the equations (7) to (12) by detecting the time differences $T_1$, $T_2$ and the height H, as similar to the first embodiment.

The principle mentioned above will be explained with reference to FIG. 8 which shows a circuit of the second embodiment realized as a practical system.

In the figure, the reference numeral 31 designates an oscillation circuit for oscillating a high frequency signal; the numeral 32 designates a modulation circuit for separating the high frequency signal into a signal A and a signal B different in their phases to output them; the numeral 33 designates a signal-A amplification circuit; the numeral 34 designates a signal-B amplification circuit; the numerals 35, 36 respectively designate driving circuits each driving the light emitting elements 14 as the second signal producing means or 15 as the first signal producing means; the numerals 37, 38 respectively designate amplification circuits each amplifying detected signals from the photosensitive elements 11*a* . . . 11*k* as the second signal detecting means or the photosensitive elements 12*a* . . . 12*n* as the first signal detecting means; the numerals 39, 40 respectively designate demodulation circuits for removing noise component and shaping the waveform of signals; the numerals 41 designates a signal-A detection circuit for receiving the signal from the demodulation circuit 39 to detect the signal A; the numeral 42 designates a signal-B detection circuit for receiving the signal from the demodulation circuit 39 to detect the signal B; the numeral 43 designates a signal-B detection circuit, similar to the above-mentioned signal-B detection circuit 42, for receiving the signal from the demodulation circuit 40 to detect the signal B; the numerals 44*a* . . . 44*k* respectively designate detection circuits each consisting of the amplification circuit 37, the demodulation circuit 39, the signal-A detection circuit 41 and the signal-B detection circuit 42; the numerals 45*a* . . . 45*n* respectively designate detection circuits each consisting of the amplification circuit 38, the demodulation circuit 40 and the signal-B detection circuit 43. The reference numeral 50 designates a signal-A interruption detecting circuit which receives a detection signal for the signal A from the signal-A detection circuit 41 and detects that the ball 6 has interrupted the light from the light emitting element 14 as the second signal producing means to the photosensitive elements 11*a* . . . 11*k;* the numeral 51 designates a signal-B interruption detecting circuit which receives a detection signal for the signal B from the signal-B detection circuit 42 and detects that the ball 6 has interrupted the light from the light emitting element 15 as the first signal producing means to the photosensitive elements 11*a* . . . 11*k;* the numeral 52 designates a signal-B interruption detecting circuit which receives a detection signal from the signal-B detection circuit 43 and tectes that the ball 6 has interrupted the light from the light emitting element 15 to the photosensitive elements 12*a* . . . 12*n;* the numeral 53 designates a position detecting circuit which receives a detection signal for the firstly occurring signal B from the signal-B detection circuit 43 and detects a light beam interrupted by the ball 6 among the light beams from the light emitting element 15 to the photosensitive elements 12*a* . . . 12*n* to output a signal indicative of the position of the photosensitive element interrupted by the ball; the numeral 55 designates a timer which starts time measurement with a firstly occurring interruption signal from the signal-A interruption detecting circuit 50 and stops its time measurement with a firstly occurring interruption signal from the signal-B interruption detecting circuit 51; the numeral 56 designates a timer which starts time measurement with a firstly occurring interruption signal from the signal-B interruption detecting circuit 51 and stops its time measurement with a firstly occurring interruption signal from the signal-B interruption detecting circuit 52; the numeral 57 designates a logical operation circuit which receives outputs from the position detecting circuit 53, and the timers 55, 56 to output data on the ball impacted such as a ball traveling angle in the horizontal direction, speed in the ball traveling direction and so on and the logical operation circuit 57 constitutes a logical operation-processing means A together with the detection circuits 44*a* . . . 44*k* and 45*a* . . . 45*n*, the signal interruption detecting circuits 50, 51, 52, the position detecting circuit 55 and the timers 55, 56; and the numeral 58 designates a display device for displaying information on the ball impacted according to the data from the logical operation circuit. The reference numeral 59 designates a selective switch for club which makes it possible to calibrate processing operations in the logical operation circuit 57 for an iron club for hitting the ball 6 on the mat 2 or an wood club for hitting the ball on the mat 2 through the tee 5.

The operation of the golf training device having a structure described above will be explained.

First of all, the selective switch 59 is switched to the position for wood club and the ball 6 on the tee 5 is hit. The ball 6 hit traverses the light planes a, b and c formed by the light emitting elements 14, 15 and the photosensitive element groups 11, 12. Each of the photosensitive element groups 11, 12 usually receives light from the respective light emitting elements 14, 15 to output respectively the signal A and the signal B from the detection circuits 44*a* . . . 44*k* and to output respectively the signal B from the detection circuits 45*a* . . . 45*n*. Interruption of the light producing by traversing of the light plane a by the ball 6 is detected by the signal-A interruption detecting circuit 50 and the output resulted by such detection states the timer 55. Subsequently, interruption of the light produced by traversing of the light plane b by the ball 6 is detected by the signal-B interruption detecting circuit 51. The output resulted by such detection causes to stop the time measurement of the timer 55 and at the same time, renders the timer 56 to start. Further, interruption of the light produced by traversing of the light plane c by the ball 6 is detected by the signal-B interruption detection circuit 52 and the position detecting circuit 53 and the output from the signal-B interruption detection circuit 52 stops the time measurement of the timer 56, while the position detecting circuit 53 outputs a signal indicative of a photosensitive element subjected to interruption of light among the photosensitive element group 12. The position detecting circuit 53 and the timers 55, 56 are all so designed that they are driven and stopped with the firstly occurring signal and are automatically reset after completion of the operations in the logical operation circuit 57. With such construction described above and by the outputs from the timers 55, 56 and the position detecting circuit 53, the logical operation circuit 57 performs processing operation according to the equations (7) to (12) to display on the display device 58 information such as the absolute velocity, the traveling angle in the horizontal direction or in the vertical direction of the ball 6 and so on.

A third embodiment of the present invention will be described with reference to FIGS. 1, 2, 4, 5, 7, 9 and 10.

In the golf training devices described in the above-mentioned embodiments, the photosensitive element groups 11, 12 which detect the time differences $T_1$, $T_2$ and the height H also produce signals for a club head swung to hit the ball 6. When a golf ball is hit by a golf club, the absolute velocity of the ball is usually greater than that of the club head, if the directional component of ball traveling is disregarded, because a repulsive force is added to the ball in addition to the speed of the movement of the club head. Accordingly, in almost every case, the ball 6 passes through light beams before the club head does and the golf training devices above-mentioned take the earliest beam-interruption signal, or a firstly occurring signal to use it as data whereby there exists no erroneous indication of the data. However, a golf club has a loft angle and a ball is driven at an angle of elevation to the ground surface. Accordingly, when the ball is driven by a golf club having a large loft angle, the club may interrupt light directed to the photosensitive element groups 11, 12 before the ball interrupts the light. In this case, if signals generated from the photosensitive element groups caused by first interruption of light are considered to be signals for the balls instead of the signals for the club head, there occurs an erroneous indication.

In order to eliminate such erroneous indication of data, the device according to the third embodiment of the present invention is constructed in such a manner that the time difference $T_1$, $T_2$ and the height H obtained by firstly occurring signals resulted by interrupting the light irradiated to the photosensitive element groups 11, 12 and the time differences $T_1'$, $T_2'$, and the height H' obtained by secondly occurring signals are measured; each absolute velocity is calculated using each group of the data in the equation above-mentioned; and the calculated value having a greater V value is displayed on the display part as data on the ball whereby the data resulted by the interruption of the light irradiated to the photosensitive element groups 11, 12 by the club head is not displayed. This embodiment of the present invention is based on the finding that the ball impacted usually has an absolute velocity (without including directional component) grreater than the club head.

FIG. 9 is diagrams showing the principle of the detection of the ball and the club head. In FIG. 9*a*, the ball 6 is impacted by the club head 73. The ball 6 is shot by repulsion on the face of the club head 73 as shown in FIG. 9*b* and firstly interferes lights to the photosensitive element groups 11, 12 to generate interruption signals and then the club head 73 lets the groups generate interruption signals as shown in FIG. 9*c*. FIG. 9*d* shows as a model generation of the signals. Thus, the detected signals firstly occurred and the detected signals secondly occurred in the photosensitive element groups 11, 12 are respectively used as detected data groups whereby the time differences $T_1$, $T_2$ and the height H and the time differences $T_1'$, $T_2'$ and the height H' are obtainable.

FIG. 10 shows an example of a circuit of the third embodiment which realizes the principle of the present invention as a practical system. The construction of the golf training device body and the principle of signal detection are the same as those of the second embodiment as described with using FIGS. 1, 2, 4, 5 and 7. Description is, therefore, omitted.

In the FIG. 10, the reference numeral 31 designates an oscillation circuit for oscillating a high frequency signal; the numeral 32 designates a modulation circuit for separating the high frequency signal into a signal A and a signal B different in their phases to output them;

the numeral 33 designates a signal-A amplification circuit; the numeral 34 designates a signal-B amplification circuit; the numerals 35, 36 respectively designate driving circuits each driving the light emitting elements 14 or 15; the numerals 37, 38 respectively designate amplification circuits each amplifying detected signals from the photosensitive elements 11*a* . . . 11*k* or the photosensitive elements 12*a* . . . 12*n*; the numerals 39, 40 respectively designate demodulation circuits for removing noise component and shaping the waveform of signals; the numerals 41 designates a signal-A detection circuit for receiving the signal from the demodulation circuit 39 to detect the signal A; the numeral 42 designates a signal-B detection circuit for receiving the signal from the demodulation circuit 39 to detect the signal B; the numeral 43 designates a signal-B detection circuit, similar to the above-mentioned signal-B detection circuit 42, for receiving the signal from the demodulation circuit 40 to detect the signal B; the numerals 44*a* . . . 44*k* respectively designate detection circuits each consisting of the amplification circuit 37, the demodulation circuit 39, th signal-A detection circuit 41 and the signal-B detection circuit 42; the numerals 45*a* . . . 45*n* respectively designate detection circuits each consisting of the amplification circuit 38, the demodulation circuit 40 and the signal-B detection circuit 43. The reference numeral 50 designates a signal-A interruption detecting circuit which receives a detection signal from the signal A from the signal-A detection circuit 41 and detects that the ball 6 and the club head 73 have interrupted the light from the light emitting element 14 to the photosensitive elements 11*a* . . . 11*k*; the numeral 51 designates a signal-B interruption detecting circuit which receives a detection signal for the signal B from the signal-B detection circuit 42 and detects that the ball 6 and the club head 73 have interrupted the light from the light emitting element 15 to the photosensitive elements 11*a* . . . 11*k*; the numeral 52 designates a signal-B interruption detecting circuit which receives a detection signal from the signal-B detection circuit 43 and detects that the ball 6 and the club head 73 have interrupted the light from the light emitting element 15 to the photosensitive elements 12*a* . . . 12*n*; the numeral 53 designates a position detecting circuit which receives a detection signal for the signal B from the signal-B detection circuit 43 and detects a light beam interrupted by the ball 6 and club head 73 among the light beams from the light emitting element 15 to the photosensitive elements 12*a* . . . 12*n* to output a signal indicative of the position of the photosensitive element interrupted by the ball and the club head; the numerals 60, 61 62 and 63 respectively designate order circuits each of which constitutes a separating means B for separating the firstly occurring signal from the secondly occurring signal among two signals produced in the signal detecting circuits 50, 51, 52 and the position detecting circuit 53. The numerals 55*a*, 56*a* respectively designate timers whose operations are controlled by the firstly occurring pulse signal. Specifically, the timer 55*a* starts time measurement by the firstly occurring interruption signal from the signal-A interruption detecting circuit 50 and stops the time measurement by the firstly occurring interruption signal from the signal-B interruption detecting circuit 51 and the timer 56*a* starts time measurement by the firstly occurring interruption signal from the signal-B interruption detecting circuit 51 and stops the time measurement by the interruption signal from the signal-B interruption detecting circuit 52. The reference numerals 55*b*, 56*b* respectively designate timers whose operations are controlled by the secondly occurring pulse signal. Specifically, the timer 55*b* starts time measurement by the secondly occurring interruption signal from the signal-A interruption detecting circuit 50 and stops the time measurement by the secondly occurring interruption signal from the signal-B interruption detecting circuit 51 and the timer 56*b* starts time measurement by the secondly occurring interruption signal from the signal-B interruption detecting circuit 51 and stops the time measurement by the secondly occurring interruption signal from the signal-B interruption detecting circuit 52. The reference numeral 57 designates a logical operation circuit which is constructed in such a manner that upon receipt of firstly occurring pulse signals of the timers 55*a*, 56*a* and the position detecting circuit 53, the angle of ball shot in the horizontal direction, the speed of the ball, the angle of elevation of the ball and so on are calculated; a similar calculations are carried out by receiving the secondly occurring pulse signals of the timers 55*b*, 56*b* and the position detecting circuit 53; both calculated data are processed according to the equation (12) to obtain each value on speed V; both the values on speed V are compared to take a data group including one having a greater speed value V as data on a ball; and the data group such as horizontal angle, speed, elevation angle and so on is output on a display part. The logical operation circuit constitutes an operation processing means A in association with the detecting circuits, signal interruption detecting circuits, the order circuits and timers. The numeral 58 designates a display device for displaying information on the ball impacted according to the data from the logical operation circuit. The reference numeral 59 designates a selective switch for club which makes it possible to calibrate processing operations in the logical operation circuit 57 for an iron club for hitting the ball 6 on the mat 2 or an wood club for hitting the ball on the mat 2 through the tee 5.

The operation of the golf training device having a structure described above will be explained.

First of all, the selective switch 59 is switched to the position for wood club and the ball 6 on the tee 5 is hit. The ball 6 hit and the club head 73 traverse the light planes a, b and c formed by the light emitting elements 14, 15 and the photosensitive element groups 11, 12. Each of the photosensitive element groups 11, 12 usually receives light from the respective light emitting elements 14, 15 to output respectively the signal A and the signal B from the detection circuits 44*a* . . . 44*k* and to output respectively the signal B from the detection circuits 45*a* . . . 45*n*. Interruption of the light producing by traversing of the light plane a by the ball 6 or the club head 73 is detected by the signal-A interruption detecting circuit 50 and the output resulted by such detection is separated by the order circuit 60 into the firstly and secondly occurring pulse signals which respectively start the timers 55*a* and 55*b*. Subsequently, interruption of the light caused by the traversing of the ball 6 and the club head 73 through the light plane b is detected by the signal-B interruption detecting circuit 51. The output is split into the firstly and secondly occurring pulses by the order circuit 61 and the firstly occurring pulse stops the time measurement of the timer 55*a* and starts the timer 56*a* while the secondly occurring pulse stops the time measurement of the timer 55*b* and starts the timer 56*b*. Further, interruption of light caused by the traversing of the ball 6 or the club head 73 through the light plane c is detected by the signal-B interruption detecting circuit 52 and the position detecting circuit 53. The output from the signal-B interruption detecting circuit 52 is split into the firstly and secondly occurring pulses by the order circuit 62 and the firstly occurring pulse stops the time measurement of the timer 56*a* and the secondly occurring pulse stops the time measurement of the timer 56*b*. The position detecting circuit 53 detects a photosensitive element subjected to interruption of light among the photosensitive element group 12 and splits the interruption signal into the firstly and secondly occurring signals to be output through the order circuit 63. The logical operation circuit 57 receives the outputs of the firstly occurring signals of the timers 55*a*, 56*a* and the position detecting circuit 53 to perform operation-processing of the outputs according to the equation (7) to (12), while it receives the outputs of the secondly occurring signals of the timers 55*b*, 56*b* and the position detecting circuit 53 to perform operation-processing of the output according to the equations (7) to (12).

Two sets of the data on speed calculated according to the equation (12) are compared to detect the data having a greater value of speed and a data group including the data of the greater value of speed is transferred to the display device 58 to display them. The device of the third embodiment enables to display correct data on a ball even when a club head firstly interrupts light.

The system of the third embodiment is applicable not only to the second embodiment but also to the first embodiment.

The fourth embodiment of the present invention will be described with reference to FIGS. 1, 2, 4, 5, 7, 9 and 11 to 13.

The fourth embodiment is a modification of the third embodiment and is also applicable to the first and second embodiments and is adapted to correctly display data on a ball even when a club head interrupts light faster than the ball. Namely, in the third embodiment, the time differences $T_1$, $T_2$ and the height H are measured by detecting the first interruption of light to the photosensitive element groups 11, 12 and the time differences $T_1'$, $T_2'$ and the height H' are measured by detecting the second interruption of light to the same; each of the absolute velocity V is calculated from these data according to the above-mentioned equation; a calculated data having a greater absolute velocity V are displayed on the display part thereby separating data caused by interruption of light by the club head, under assumption that the absolute velocity of the golf ball usually greater than the movement of the club head unless an apparent miss-shot is took place by a player. However, an apparent miss-shot occurs, the absolute velocity of the ball 6 may be smaller than the moving speed of the club head, which may invite an erroneous indication of data.

The golf training device of the fourth embodiment is constructed in such a manner that the moving speed of the club head is separately measured by way as shown in FIGS. 11 and 12; the resulted value is compared with the value measured through the photosensitive element groups 11, 12; and when both the values are substantially the same or the value for the club head is greater than that for the ball, indication of error (such as "E") is displayed on the display part 21 instead of the data on the ball. The fourth embodiment is based on the fact that the absolute velocity of the ball is greater than the moving speed of the club head and the moving speed of the club head before impacting the ball is greater than that after impacting, unless an apparent miss-shot takes place.

FIGS. 11 and 12 are schematic views showing an example of measuring the speed of a club head in which a pair of coaxial optical fibers 71, 72 are placed in the first base plate 3 so that each end of the optical fibers exposes on the surface of the first base plate 3 and they are apart a predetermined distance from each other and behind the ball 6 on the mat in the golf-club swing direction. The other end of the inner axis of each of the coaxial optical fibers 71, 72 is subjected to incidence of light through the light emitting element 66 and the incident light is received at the other end of the outer axis through the photosensitive elements 60, 61. When a club head 73 passes over the optical fibers, the photosensitive elements 60, 61 detect signals and the speed of the club head is calculated according to the equation 13 by measuring a time difference $T_H$ between both the signals.

$$V_H=(S/T_H) \tag{13}$$

By comparing the moving speed of the head with the absolute velocity V calculated according to the equation (12), the velocity V is judged as a ball speed when the velocity V has a greater value and data calculated according to the equations (9), (11), (12) and so on are displayed on the display part 21. On the other hand, when the velocity V is the same or smaller than the speed $V_H$, a mingled data of the club head 73 and the ball at the apparent miss-shot are detected by the photosensitive element groups 11, 12 whereby indication of error such as "E" is provided instead of measurement data on the ball, thus erroneous information can be avoided.

In the fourth embodiment, the construction of the golf training body and the principle of the detection are the same as those of the second embodiment described with reference to FIGS. 2, 4, 5 and 7 and therefore description is omitted.

The principle of the fourth embodiment will be explained with reference to FIG. 13 which shows a circuit realized as a practical system.

In the figure, the reference numeral 31 designates an oscillation circuit for oscillating a high frequency signal; the numeral 32 designates a modulation circuit for separating the high frequency signal into, for instance, a signal A and a signal B different in their phases to output them; the numeral 33 designates a signal-A amplification circuit; the numeral 34 designates a signal-B amplification circuit; the numerals 35, 36 respectively designate driving circuits each driving the light emitting elements 14 or 15; the numerals 37, 38 respectively designate amplification circuits each amplifying detected signals from the photosensitive elements 11*a* . . . 11*k* or the photosensitive elements 12*a* . . . 12*n*; the numerals 39, 40 respectively designate demodulation circuits for removing noise component and shaping the waveform of signals; the numerals 41 designates a signal-A detection circuit for receiving the signal from the demodulation circuit 39 to detect the signal A; the numeral 42 designates a signal-B detection circuit for receiving the signal from the demodulation circuit 39 to detect the signal B; the numeral 43 designates a signal-B detection circuit, similar to the above-mentioned signal-B detection circuit 42, for receiving the signal from the demodulation circuit 40 to detect the signal B; the numerals 44*a* . . . 44*k* respectively designate detection circuits each consisting of the amplification circuit 37, the demodulation circuit 39, the signal-A detection circuit 41 and the signal-B detection circuit 42; the numerals 45*a* . . . 45*n* respectively designate detection circuits each consisting of the amplification circuit 38, the demodulation circuit 40 and the signal-B detection circuit 43. The reference numeral 50 designates a signal-A interruption detecting circuit which receives a detection signal for the signal A from the signal-A detection circuit 41 and detects that the ball 6 has interrupted the light from the light emitting element 14 to the photosensitive elements 11*a* . . . 11*k*; the numeral 51 designates a signal-B interruption detecting circuit which receives a detection signal for the signal B from the signal-B detection circuit 42 and detects that the ball 6 has interrupted the light from the light emitting element 15 to the photosensitive elements 11*a* . . . 11*k*; the numeral 52 designates a signal-B interruption detecting circuit which receives a detection signal from the signal-B detection circuit 43 and detects that the ball 6 has interrupted the light from the light emitting element 15 to the photosensitive elements 12*a* . . . 12*n*; the numeral 53 designates a position detecting circuit which receives a detection signal for the signal B from the signal-B detection circuit 43 and detects a light beam interrupted by the ball 6 among the light beams from the light emitting element 15 to the photosensitive elements 12*a* . . . 12*n* to output a signal indicative of the position of the photosensitive element interrupted by the ball; the numeral 55 designates a timer which starts time measurement with an interruption signal from the signal-A interruption detecting circuit 50 and stops its time measurement with an interruption signal from the signal-B interruption detecting circuit 51; the numeral 56 designates a timer which starts time measurement with an interruption signal from the signal-B interruption detecting circuit 51 and stops its time measurement with an interruption signal from the signal-B interruption detecting circuit 52; the numerals 60, 61 designate photosensitive elements for detecting a signal produced in the coaxial optical fibers 71, 72 which are provided in the mat to measure the moving speed of the club head, the signal indicating that the club head have passed on the optical fibers; the numerals 62, 63 designate amplification circuits; the numeral 64 designates a timer for measuring time required for movement of the club head; the numeral 65 designates a divider circuit for converting data from the timer into speed; and the numerals 66, 67 respectively designate light emitting element and a driver circuit for driving the element.

The numeral 57 designates a logical operation circuit which receives outputs from the position detecting circuit 53 and the timers 55, 56 to output data on a ball such as angle in the horizontal direction of a ball driven by a golf club, speed in the ball traveling direction and so on; compares the speed of the ball in the ball traveling direction with the speed of the club head separately calculated; and if data obtained by the comparison satisfy a predetermined condition, the data is output on the display part, otherwise, indication of error such as "E" is output on the display part. The logical operation circuit 57 constitutes an operation processing means A in association with the detection circuits, the signal interruption detecting circuits and the timers. The numeral 58 designates a display device for displaying information on the ball impacted according to the data from the logical operation circuit. The reference numeral 59 designates a selective switch for club which makes it possible to calibrate processing operations in the logical operation circuit 57 for an iron club for hitting the ball 6 on the mat 2 or an wood club for hitting the ball on the mat 2 through the tee 5.

The operation of the golf training device having a structure described above will be explained.

First of all, the selective switch 59 is switched to the position for wood club and the ball 6 on the tee 5 is hit. The ball 6 hit and the club head 73 traverse the light planes a, b and c formed by the light emitting elements 14, 15 and the photosensitive element groups 11, 12. Each of the photosensitive element groups 11, 12 usually receives light from the respective light emitting elements 14, 15 to output respectively the signal A and the signal B from the detection circuits 44*a* . . . 44*k* and to output respectively the signal B from the detection circuits 45*a* . . . 45*n*. Interruption of the light producing by traversing of the light plane a by the ball 6 or the club head 73 is detected by the signal-A interruption detecting circuit 50 and the output resulted by such detection starts the timer 55. Subsequently, interruption of the light produced by traversing of the light plane b is detected by the signal-B interruption detecting circuit 51. The output resulted by such detection causes to stop the time measurement of the timer 55 and at the same time, renders the timer 56 to start. Further, interruption of the light produced by traversing of the light plane c by the ball 6 or the club head 73 is detected by the signal-B interruption detection circuit 52 and the position detecting circuit 53 and the output from the signal-B interruption detection circuit 52 stops the time measurement of the timer 56, while the position detecting circuit 53 outputs a signal indicative of a photosensitive element subjected to interruption of light among the photosensitive element group 12. The position detecting circuit 53 and the timers 55, 56, 64 are all so designed that they are driven and stopped with the firstly occurring signal and are automatically reset after completion of the operations in the logical operation circuit 57. With such sontruction described above and by the outputs from the timers 55, 56 and the position detecting circuit 53, the logical operation circuit 57 performs processing operation according to the equations (7) to (12) and compares the speed of the head given by the divider circuit 65 with the speed calculated according to the equation (12) to output on the display device 58 data operated by the logical operation circuit 57 only when the speed of the equation (12) is greater than the speed of the divider circuit. When the speed given by the equation (12) is smaller, the data are not transferred to the display device 58, but indication of error is output. In the fourth embodiment, data on the ball such as the absolute velocity, each angle in the horizontal and the vertical directions can be correctly displayed.

The fourth embodiment can be obtained by modifying the structure of the second embodiment. It is possible to apply the idea of the fourth embodiment into the first embodiment.

In the fourth embodiment, the coaxial optical fibers 71, 72, the light emitting element 66 and the photosensitive elements 60, 61 are used as sensors to detect the moving speed of the club head, it is, however, possible to use a sensor such as a magnetic sensor in which a coil is wrapped around a magnet. Although the number of the sensor for detecting the moving speed of the club head can be single in a theoretical viewpoint, it is desirable to use a pair of sensors.

The operation circuit used in the first to fourth embodiments can be a combination of M5L8085 (8 bit CPU), M58496-081P (4 bit MPV) and M58496-082P (4 bit MPU) manufactured by Mitsubishi Denki Kabushiki Kaisha.

FIG. 14 shows a modification of arrangement of the photosensitive element groups 11, 12 of the preceding embodiments in which photosensitive element groups are in two rows.

In FIG. 14, the part, portion and elements designated by the reference numerals 2, 6, 10 and 15 have the same structure as in those of the embodiments mentioned above. The reference numeral 75 designates a second signal detection means consisting of a pair of photosensitive element groups 77 and 78 which are arranged in the vertical direction with respect to the upper surface of the mat 2 and are parallel each other. The reference numeral 76 designates a first signal detection means consisting of a photosensitive element group which is arranged in parallel to the photosensitive element groups 77, 78. The numeral 80 designates a group of openings perforated so that only light from the light emitting element 14 irradiates the photosensitive element group 77; the numeral 81 designates a group of openings perforated so that only light from the light emitting element 14 irradiates the photosensitive element groups 78 and the numeral 83 designates a group of openings perforated so that only light from the light emitting element 15 irradiates the photosensitive element group 76.

Even with the construction of the embodiment described above, a ball traveling angle in the horizontal direction can be calculated to be displayed according to the same principle for operation as in the embodiments and the same effect can be obtained.

In these embodiments, a light emitting element is used as a signal producing means and a photosensitive element are used as a signal detecting means. However, use of these elements is not critical and for instance, a combination of an ultrasonic producing element and an ultrasonic detecting element may be used as long as it can detect traversing of a ball.

We claim:

1. A golf training device for detecting movement of a golf ball impacted to display data on the ball which comprises:

a supporting body which extends toward a golf ball traveling direction and which has a signal producing means holding part on one side and a signal detecting means holding part on the other side with respect to the reference axis of the golf ball traveling direction, first and second light signal producing means placed along the golf ball traveling direction at a predetermined distance on the signal producing means holding part of said supporting body to emit, including means to emit light signals where the phase of the first light signal is different from the phase of the second light signal in at least an area where the golf bass is passed, a first light signal detecting means for detecting the first light signal from at least said first light signal producing means including means to output a detection signal and a second light signal detecting means for discriminately detecting each of the signals from said first and second light signal producing means including means to output a detection signal, both of the light signal detecting means being arranged along the golf ball traveling direction at a predetermined distance on the light signal detecting means holding part of said supporting body and wherein the discrimination between said first and second signals is at least partially accomplished by the phase difference between said first and second light signals, an operation-processing means which receives output signals from said first and second light signal detecting means and processes data on said golf ball based on said received signals, and a display means for displaying the result of the processing in said operation-processing means.

2. A golf training device according to claim 1 wherein said light signal detecting means holding part extends upwardly from said supporting body at a predetermined length and has first and second light signal detecting means which are respectively vertically arranged.

3. A golf training device according to claim 1 wherein said operation-processing means includes a separating means for separating a detection signal indicative of movement of a golf ball which is output from said first and second light signal detecting means, from a detection signal indicative of movement of a club head and is capable of outputting the result of operation of the detection signal indicative of movement of the ball to said display means.

4. A golf training device for detecting movement of a golf ball impacted to display data on the ball which comprises:

a first base plate for a golf ball, a club head moving speed detecting means comprising:

at least two elements which are placed in a predetermined distance in the golf ball traveling direction each having:

a coaxial optical fiber where one end is exposed on the surface of said first base plate;

a light emitting element placed at the opposite end from that exposed on said base plate, wherein said light emitting element is placed on the inner axis of said optical fiber; and a photosensitive element placed at the opposite end from that exposed, wherein said light emitting element is placed on said base plate on the outer axis of said optical fibers provided in said first base plate, which detects the moving speed of said club head, and means to output a detection signal, a second base plate which extends toward a golf ball traveling direction and which has a signal detecting means holding part on one side and a signal detecting means holding part on the other side with respect to the reference axis of the golf ball traveling direction, a first and second signal producing means placed along the golf ball traveling direction at a predetermined distance on the signal producing means holding part of said second base plate including means to emit signals to at least an area where the golf ball is passed, a first signal detecting means for detecting a signal from at least said first signal producing means further including means to output a detection signal and a second signal detecting means for detecting the signals from said first and second signal producing means, further including means to output a detection signal, both of the signal detecting means being arranged along the golf ball traveling direction at a predetermined distance on the signal detecting means holding part of said second base plate, an operation-processing means constructed in such a manner that an output signal from said club head moving speed detecting means is received including means to process the data on club head moving speed; an output signal from said first and second signal detecting means is received to perform processing of the data on the ball including speed of the ball; the data on the moving speed of said club head moving speed detecting means is compared with the data on the speed of the ball obtained based on the output signal from said first and second signal detecting means; and the data on the speed and other data of the ball are output to be displayed when the speed of the club head is smaller than the speed of the ball, otherwise indication of error is output without displaying the data on speed of the ball, and a display means for displaying the result of the processing in said operation-processing means.

5. A golf training device according to claim 4 wherein said signal detecting means holding part extends upwardly from said supporting body at a predetermined length and has first and second signal detecting means which are respectively vertically arranged.

6. A golf training device according to claim 5 wherein said first and second signal producing means are respectively composed of first and second light emitting elements and said first and second signal detecting means are respectively composed of a plurality of photosensitive elements which are arranged with a distance between them smaller than that of the diameter of a golf ball.

7. A golf training device according to claim 6 wherein said first and second light emitting elements respectively emit beams whose phases are different from each other.

* * * * *